United States Patent [19]

Smith

[11] 4,136,321

[45] Jan. 23, 1979

[54] REED RELAY ASSEMBLY AND THE METHOD OF MAKING SAME

[75] Inventor: Philip N. Smith, Cincinnati, Ohio

[73] Assignee: Standex International Corporation, Andover, Mass.

[21] Appl. No.: 784,274

[22] Filed: Apr. 4, 1977

[51] Int. Cl.[2] ..... H01H 51/28

[52] U.S. Cl. ..... 335/151; 335/202

[58] Field of Search ..... 335/202, 151, 152, 153, 335/154; 29/622

[56] References Cited

U.S. PATENT DOCUMENTS

| | | | |
|---|---|---|---|
| 3,171,918 | 3/1965 | Killion | 335/202 |
| 3,218,407 | 11/1965 | Bengtsson | 335/202 |
| 3,268,686 | 8/1966 | Wauer | 335/154 |
| 3,387,240 | 6/1968 | Koppensteiner | 335/153 |
| 3,434,079 | 3/1969 | Ege, Jr. | 335/151 |
| 3,928,829 | 12/1975 | Abrams | 335/151 |
| 3,940,722 | 2/1976 | Fox et al. | 335/151 |

*Primary Examiner*—Harold Broome

*Attorney, Agent, or Firm*—Wood, Herron & Evans

[57] ABSTRACT

A reed relay wherein a glass-encapsulated switch having leads projecting longitudinally from each end is inserted in a longitudinal bore in a bobbin. A cover having a top wall, side walls and end walls is applied to the bobbin. One end wall is slotted to receive one of the leads of the switch. The combination of the bobbin, the cover and the slot capturing one of the leads effects the immobilization of both leads and the switch when the cover is applied. The cover is ultrasonically welded to the bobbin.

7 Claims, 10 Drawing Figures

REED RELAY ASSEMBLY AND THE METHOD OF MAKING SAME

This invention relates to a reed relay assembly and the method of assembling a glass-encapsulated switch, bobbin and cover.

Reed relays of the type to which the present invention is directed are well known in the art. In general, the reed relay consists of an elongated glass-encapsulated switch having leads projecting longitudinally from each end of the switch. The switch is inserted into a bobbin which has an electrically-conductive coil wound upon it, the ends of the coil being connected to coil terminals which are secured to the bobbin. The coil terminals usually extend transversely to the longitudinal axis of the bobbin and project from each side of the bobbin. At one side, where the ends of the coil are connected to the coil terminals, thereby forming horns, the projecting terminals or horns are bent through 90° to lie along the surface of the bobbin.

The glass which encapsulates the switch tends to be somewhat fragile and the joint between the switch leads and glass is subject to breakage if roughly handled. It is therefore desirable to capture and immobilize the switch leads as well as to maintain the horns or terminals to which the coil ends are connected out of contact with each other to avoid short circuits.

There are, in the prior art, a wide variety of approaches to the formation of a reed relay assembly of the type described above. Among these are three which are currently practiced in the art. One very inexpensive approach has been to surround the coil with a first wrap of insulative tape, bend the horns down along the tape and thereafter cover the horns with a second wrap of insulated tape. The switch leads are bent downwardly at right angles to the longitudinal axis of the bobbin and captured in slots formed in flanges projecting integrally from the bobbin. The thus formed reed relay may then be mounted on a printed circuit board, for example, with the switch leads and coil leads soldered to appropriate terminals on the printed circuit board.

A second and fairly expensive approach has been to place the switch in a bobbin with the coil wound thereon and place that assembly in a molding cavity. Thereafter, the assembly is surrounded with an epoxy, thereby completely enclosing all parts of the relay except the projecting leads.

Still another approach has been to form the bobbin with switch terminals, similar to the coil terminals formed in the bobbin. After insertion of the glass-encapsulated switch into the bobbin, the switch leads are soldered to the switch terminals, thereby immobilizing them.

Each of these approaches has its disadvantages from the standpoint of cost of labor and materials or from the standpoint of ruggedness and ability to withstand hard usage without damage.

The objective of the present invention has been to provide a reed relay and an assembly method which is relatively inexpensive but which, nevertheless, effects a secure mounting of the switch in the bobbin and substantially immobilizes the switch leads, thereby preventing breakage during handling. The objectives of the invention are achieved by providing a thermoplastic bobbin having a longitudinal bore therethrough, the bore terminating in a very small aperture of just sufficient size to permit one of the switch leads to pass therethrough when the switch is inserted in the bobbin. A thermoplastic cover having a top wall, two side walls and two end walls is applied to the bobbin in such a way as to substantially enclose the switch receiving bore and to capture and substantially immobilize the switch leads. To this end, one end wall of the cover has a slot whose width is approximately the same dimension as the diameter of the switch lead. The other end wall extends downwardly from the top wall a distance just sufficient to engage the other switch lead and clamp it against the bobbin through which it projects.

In assembly, the coil on the bobbin is covered with a single wrap of insulated material and the coil horns are laid down on the wrap. The cover is held at an acute angle to the bobbin with the slotted end wall positioned adjacent the larger end of the bobbin bore through which the switch had previously been inserted. At this angulated position, one of the leads of the switch can be inserted into the slot of the wall. Thereafter, the cover is slid over the bobbin and positioned downwardly on the bobbin so that the opposite end wall clamps the other projecting lead against the bobbin.

The top wall has internally-projecting longitudinally-extending ribs which, when the cover is assembled to the bobbin, separate the horns lying in a longitudinally-extending attitude on the insulated tape.

The bobbin has longitudinally-projecting flanges which are slotted. The switch leads, substantially immobilized by the application of the cover, are then bent at right angles so as to be captured in the slots of the flanges. The bobbin and cover which are both thermoplastic are then treated ultrasonically to weld the cover to the bobbin.

The final assembly thus has two switch leads projecting downwardly and two coil terminals projecting downwardly in a position for application to a printed circuit board or the like. The thus assembled reed relay has a dust cover, provided by the cover described, it has the switch and switch leads immobilized; it has eliminated one wrap of insulative tape; and it has maintained the coil horns physically separated, thereby eliminating any possibility of short-circuiting.

The reed relay, as thus described and as it will be described in greater detail below, has a single switch inserted in a bobbin and covered. It is to be understood that the invention is equally applicable to a reed relay system wherein a plurality of switches are inserted into parallel bores in a single bobbin and thereafter covered by a cover having a slotted end wall to receive a plurality of switch leads.

The several features and objectives of the invention will become more readily apparent from the following detailed description taken in conjunction with the accompanying drawings in which.

Figure 1:
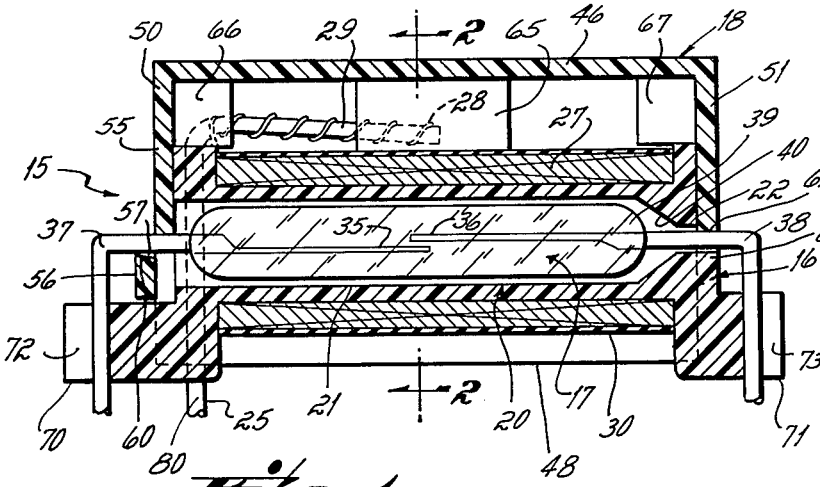
FIG. 1 is a cross-sectional view of the relay assembly taken along a longitudinal plane through the center of the assembly.

The reed relay of the present invention is shown at 15 in FIG. 1. It includes a thermoplastic bobbin 16, a glass-encapsulated switch 17 inserted in the bobbin and a thermoplastic cover 18 enclosing the bobbin and switch. The bobbin 16 is elongated and has a longitudinal bore 20 which has a large opening 21 at one end and a small aperture 22 at the other end. At one end of the bobbin a pair of coil lead terminals 25 are inserted. Preferably, the coil terminals are serrated along their length so as to provide substantial resistance against inadvertent removal. An electrically-conductive coil 27 is wound on the bobbin and respective ends 28 of the coil are wrapped about the upwardly-projecting ends or horns 29 of the terminals 25 and are soldered thereto. A wrap of insulative tape 30 is applied to the coil and the horns are bent through about 90° into a longitudinal attitude overlying the insulative tape.

The switch 17 has two contacts 35, 36 which are integral with leads 37, 38, respectively. The contacts are enclosed in an elongated glass capsule 39. The encapsulated switch is disposed in the bore 20 with the lead 38 projecting through the small aperture 22. The bore adjacent the aperture 22 is tapered into a funnel shape as at 40 to facilitate the insertion of the lead 38 through the aperture 22.

The cover 18 is mounted on the bobbin 16. The cover has a top wall 46 and two side walls 47, 48 and two end walls 50, 51. The end wall 50 is formed by an upper portion 55 and a lower portion or strap 56 which are vertically spaced from each other with the lower strap 56 being offset outwardly from the upper portion to create an offset slot 57 in the end wall 50. The strap 56 has an upper edge 60 which is beveled at about a 10° angle downwardly and inwardly to facilitate assembly, as will be described below.

The end wall 51 is vertically dimensioned so that when the cover is applied to the bobbin, a lower edge 62 engages the projecting switch lead 38 and clamps against a shoulder 63 on the bobbin.

Figure 2:
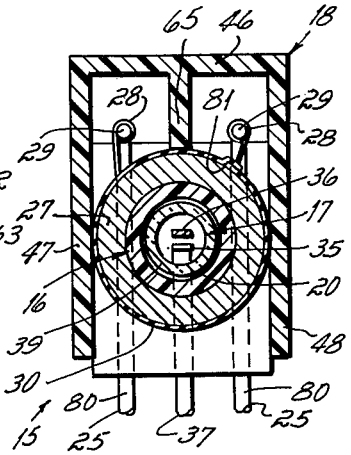
FIG. 2 is a cross-sectional view taken along lines 2—2 of FIG. 1.

The top wall 46 of the cover has a longitudinal rib structure formed by a center rib 65 and two end ribs 66, 67. It can be seen from FIGS. 1 and 2 that when the cover is in place, the ribs 65, 66 extend between the coil horns 29 and maintain them electrically separated from one another.

The bobbin has flanges 70, 71 projecting from each end. The flange 70 has a slot 72 and the flange 71 has a slot 73, both slots being of the same width as the diameter of the leads 37, 38. The leads 37, 38 are bent downwardly so as to be captured in the slots 72 and 73.

Figure 3:
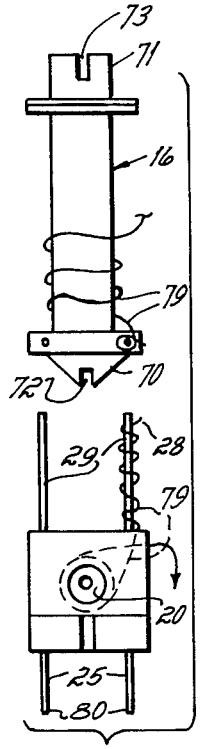
FIGS. 3, 4 and 5 illustrate a sequence of steps in forming the wound and wrapped bobbin.
Figure 4:
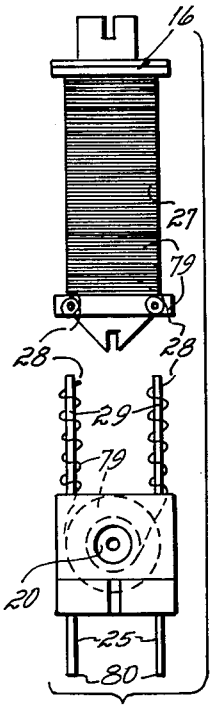

The steps of assemblying the relay are illustrated in FIGS. 3–10. As shown in FIG. 3, a previously molded bobbin has two coil terminals 25 extending transversely through one end of the bobbin to present lower ends 80 and upper ends or horns 29. An electrically-conductive wire 79 which forms the coil 27 has a first end 28 wrapped about the upper end 29 of the terminal 25 and then wound on the bobbin. After winding, the free end 28 of the wire 79 is wrapped about the other terminal 25 at its upper end 29 (FIG. 4).

Figure 5:
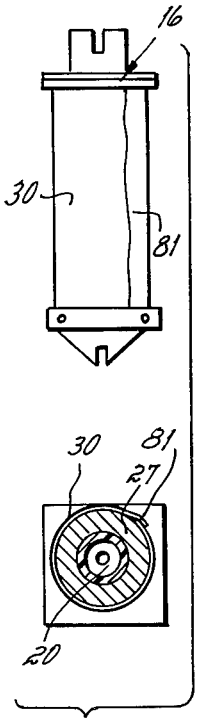

A single wrap of electrically-conductive tape 30 is applied to the coil with a very slight overlap as at 81 (FIG. 5).

Figure 6:
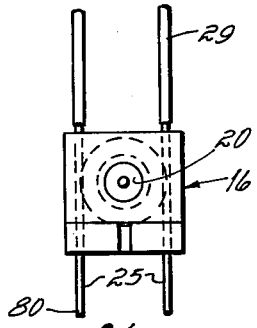
FIG. 6 is an end elevational view of the bobbin after the wrap of tape has been applied.

The horns 29 are dipped in molten solder to form a secure electrical connection of the coil ends to the respective terminals 25 (FIG. 6).

Figure 7:
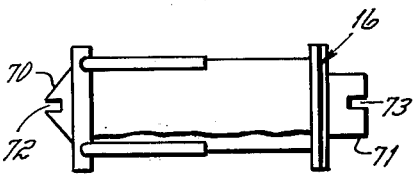
FIG. 7 is a top plan view of the bobbin after the coil terminals have been laid down on the bobbin.

The horns 29 are bent into a longitudinal attitude to lie alongside the taped coil as shown in FIG. 7.

Figure 8:
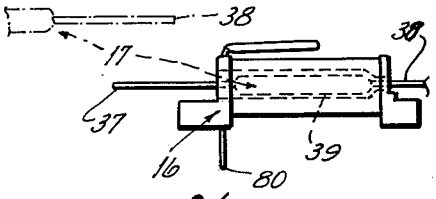
FIG. 8 is a diagrammatic side elevational view illustrating the step of inserting the switch into the bobbin.

A switch 17 is longitudinally inserted into the bore 20 of the bobbin 16 with the lead 38 projecting through the aperture 22, as shown in FIG. 8.

Figure 9:
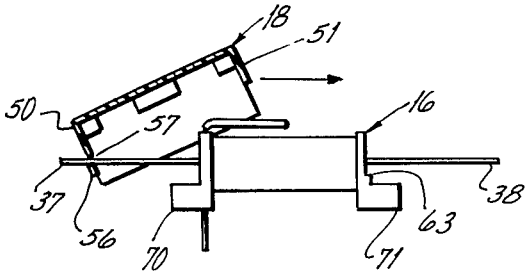
FIGS. 9 and 10 illustrate the steps of applying the cover to the bobbin.
Figure 10:
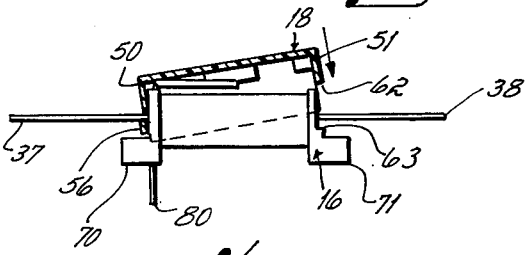

The cover 18 is initially held at an acute angle to the longitudinal axis of the bobbin, as illustrated in FIG. 9. In that attitude, the lead 37 is inserted into the slot 57 riding along the beveled upper edge 60 of the strap 56. With the cover and bobbin held at the acute angle illustrated in FIG. 9, the width of the slot is just sufficient to permit the lead 37 to slide through it. Thereafter, the cover is slid down over the bobbin as shown in FIG. 10 and snapped into place. In thus applying the cover, the vertical dimension of the slot 57 is slightly less than the diameter of the lead so that the slotted end wall 50 tends to squeeze down on the lead, thereby substantially immobilizing it. The other end wall 51 clamps the lead 38 against the shoulder 63, thereby immobilizing it and securely capturing the capsule against movement within the bore. Thereafter, the leads 37 and 38 are bent down and slipped into their respective slots 72, 73.

The bobbin and cover are then treated ultrasonically to weld them together, thereby completing the assembly.

When the relay is completed as described, the coil terminals 25 and switch leads 37, 38 are in a proper attitude for connection into the circuit for which the reed relay is required. The switch is securely held in the assembly by the clamping of the leads 37 and 38. The bobbin has been provided with a dust cover. The horns 29 are maintained in electrical isolation. A multiple wrap of insulated tape has been reduced to a single wrap. The application of the dust cover has been found to be less expensive than providing the multiple wrap of insulative wrap. Thus, an improved relay assembly has been provided at less expense than the less secure relay of the prior art described above.

I claim:

1. A reed switch assembly comprising,
   a bobbin having a coil wound thereon,
   said bobbin having a bore therethrough, said bore terminating in a small aperture,
   a glass-encased switch having leads projecting from each end, said switch being disposed in said bore with one lead projecting through said aperture,
   a cover on said bobbin having a top wall, side walls, and two end walls,
   one of said end walls having a slot of substantially the same width as the diameter of said lead, said slot overlying the large end of said bore and receiving said lead wire to immobilize it.

2. A reed switch assembly as in claim 1 in which said other end wall rests against the other lead and clamps it against said small aperture.

3. A reed switch assembly as in claim 1 further comprising,
   flanges projecting from the ends of said bobbin below said cover,
   each said flange having a notch therein to receive a respective lead which is bent downwardly at substantially right angles, thereby further capturing and immobilizing said leads.

4. A reed switch as in claim 1 in which said slot is formed by an upper portion of said end wall and a lower strap portion of said end wall which is spaced downwardly and outwardly from said upper portion thereby creating a slot which is slightly wider than said lead to facilitate introduction of said lead into said slot at an acute angle to said end wall, said slot clamping said lead when said wall is perpendicular to said lead.

5. A reed switch assembly comprising, a bobbin having a bore therethrough, a glass-encased switch having leads projecting from each end, said switch being disposed in said bore, said bobbin having a shoulder underlying one of said leads, a cover on said bobbin having a top wall, side walls and two end walls, the application of said cover to said bobbin causing an end wall to engage said lead and clamp it against said shoulder substantially immobilizing the lead on said switch.

6. A reed switch assembly as in claim 5 further comprising, a single wrap of insulative tape around said bobbin.

7. A reed switch assembly comprising, a bobbin having a bore therethrough, a glass-encased switch having leads projecting from each end, said switch being disposed in said bore, a cover on said bobbin having a top wall, side walls and two end walls, the application of said cover to said bobbin substantially immobilizing the leads on said switch, a coil wound on said bobbin, a pair of coil terminals mounted in said bobbin and having lower ends projecting transversely through said bobbin, said terminals having upper ends connected to said coil and lying transversely along the top of said coil, the top wall of said cover having an internal longitudinal rib projecting between said upper ends.

* * * * *